United States Patent [19]

Dimarco et al.

[11] 4,209,760

[45] Jun. 24, 1980

[54] CIRCUIT BREAKER AND ACCESSORY DEVICES THEREFOR

[75] Inventors: Bernard Dimarco, Bellfontaine; Andrew J. Kralik, Marysville, both of Ohio; Norman P. Perkins, Jr., Westminster, Md.

[73] Assignee: Gould Inc., Rolling Meadows, Ill.

[21] Appl. No.: 909,449

[22] Filed: May 25, 1978

[51] Int. Cl.[2] ..... H01H 73/12; H01H 75/00; H01H 67/02

[52] U.S. Cl. ..... 335/17; 335/132

[58] Field of Search ..... 335/6, 17, 20, 132, 335/202

[56] References Cited

U.S. PATENT DOCUMENTS

| | | | |
|---|---|---|---|
| 3,388,353 | 6/1968 | Isler | 335/132 |
| 3,388,357 | 6/1968 | Lawson et al. | 335/17 X |
| 3,720,891 | 3/1973 | Nicol | 335/17 X |
| 3,949,333 | 4/1976 | Freitag et al. | 335/132 |
| 4,088,973 | 5/1978 | Kussy et al. | 335/6 |

*Primary Examiner*—Fred L. Braun

*Attorney, Agent, or Firm*—Ostrolenk Faber Gerb & Soffen

[57] ABSTRACT

A multi-pole circuit breaker is provided with a molded insulating housing defining an internal chamber wherein the mechanical trip free contact operating mechanism is disposed, an external recess wherein an auxiliary switch unit is removably mounted, and an external cavity wherein a shunt trip assembly is removably mounted. The switch unit includes one switch operable by the mechanism as it opens and closes the circuit breaker contacts and a second switch operated by the latchable cradle of the mechanism to indicate automatic tripping. The shunt trip assembly includes an electromagnet having an operating member which engages the cradle latch to release the latter.

7 Claims, 13 Drawing Figures

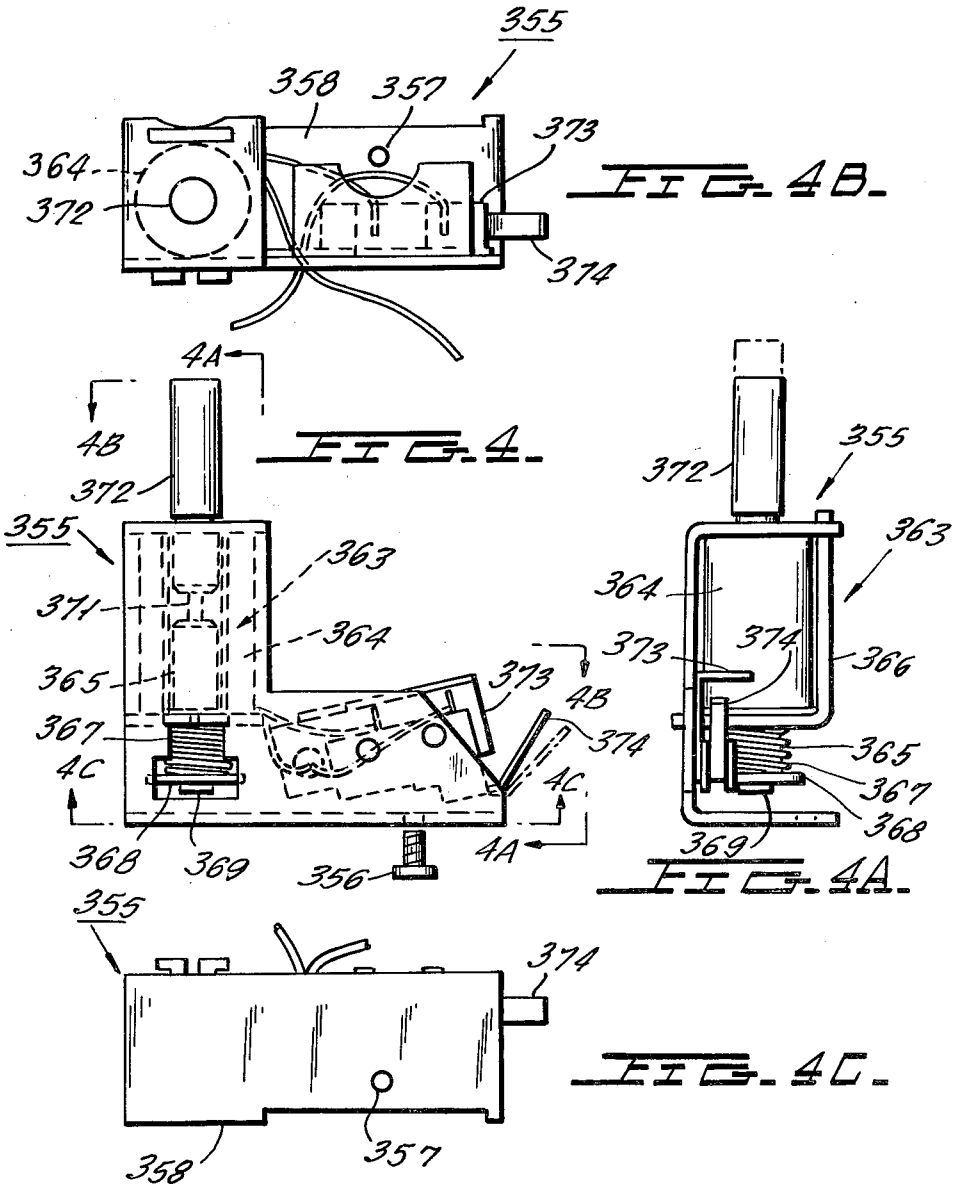
FIG. 4B.
FIG. 4.
FIG. 4A.
FIG. 4C.
355
357
358
364
372
373
374
363
365
366
367
368
369
371
4A
4B
4C
356
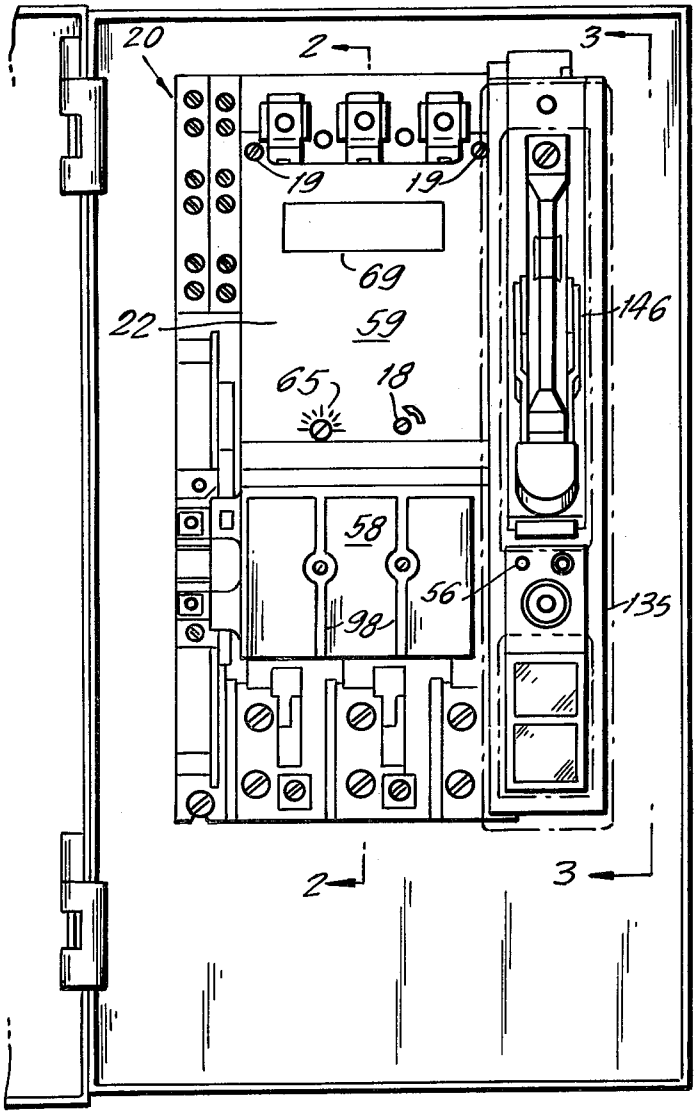
FIG. 7.
146
135
3
2
19
69
59
18
65
56
58
98
20
22

300
302
303
304
306
307
311
312
313
314
315
316
317
318
319
325
326
328
329
336
5A
5B
5C

CIRCUIT BREAKER AND ACCESSORY DEVICES THEREFOR

This invention relates to multi-pole molded case circuit breakers in general and more particularly relates to circuit breakers of this type having provisions for mounting accessory devices without the necessity of opening the circuit breaker housing.

Multi-pole molded cases circuit breakers of the prior art were usually constructed as relatively compact units so that the available space for accessory units, such as shunt trip devices, undervoltage devices, and auxiliary switches, has been scarce. Typically, these accessory devices have been disposed within the circuit breaker housing and as a result the housing cover had to be removed in order to mount accessory devices. Because of this, factory rather than field installation of accessory devices has been the rule.

To simplify field installation, the instant invention provides a circuit breaker construction in which the molded housing includes an internal chamber having a mechanical trip-free contact operating mechanism disposed therein. The housing is provided with an external recess for mounting auxiliary switches and is also provided with an external cavity wherein a shunt trip device is mounted.

The auxiliary switches include operating projections which extend through aperture means connecting the recess to the operating mechanism chamber and are positioned for operation by the mechanism. When one of the auxiliary switches functions as an alarm switch, its operating projection is positioned for operation by the releasable cradle of the operating mechanism so that the alarm switch operates on tripping of the breaker rather than on mere opening thereof. The shunt trip includes an electromagnet which operates an element projecting through another aperture connecting the cavity to the recess. This latter element trips a latch which releases the cradle of the mechanism whereby the latter opens the circuit breaker. A normally open switch in series with the electromagnet coil includes an operating member extending from the cavity to the chamber for operation of this last noted operating member by the mechanism in a manner such that this switch is closed by closing the circuit breaker. This prevents excessive periods of energization for the solenoid.

Accordingly, a primary object of the instant invention is to provide a multi-pole circuit breaker having a novel construction for the mounting of accessory devices.

Another object is to provide a circuit breaker of this type in which accessory devices are mounted without the necessity of opening the circuit breaker housing.

A further object is to provide a circuit breaker of this type in which accessory devices are mounted in external cavities of the circuit breaker housing.

A still further object is to provide a circuit breaker of this type in which the overall dimensions remain essentially the same whether accessories are or are not mounted in their operative positions relative to the contact operating mechanism of the circuit breaker.

These objects as well as other objects of this invention shall become readily apparent after reading the following description of the accompanying drawings in which:

FIG. 1 is a plan view of a unitized combination starter mounted in an enclosure, with the starter including a circuit breaker and accessory devices constructed in accordance with teachings of the instant invention.

FIG. 4 is a side elevation of the auxiliary device assembly, in this case a shunt trip.

FIGS. 4A–4C are elevations of the shunt trip device looking in the directions of the respective arrows 4A—4A, 4B—4B and 4C—4C of FIG. 4.

Figure 2:
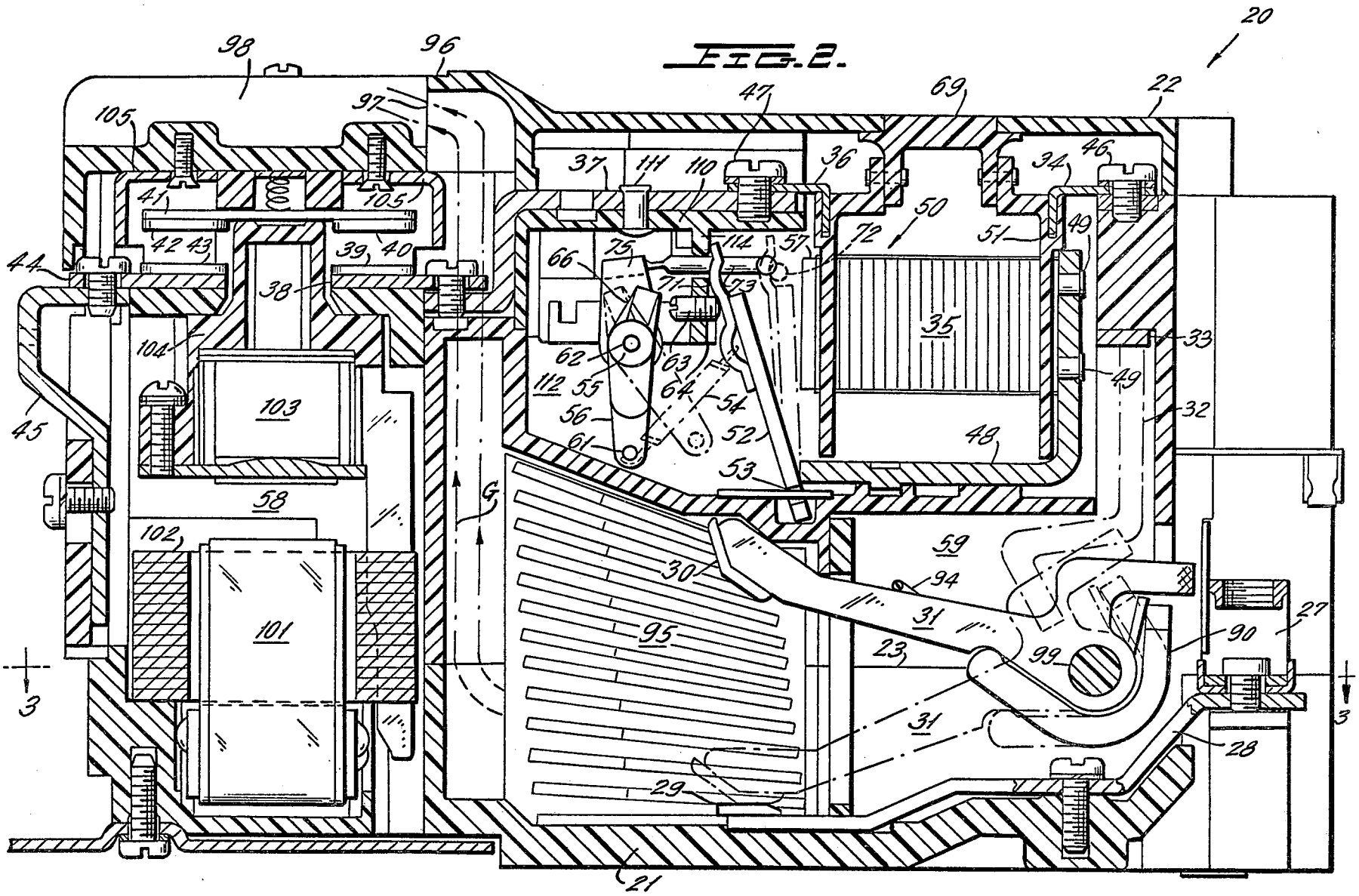
FIG. 2 is a longitudinal cross-section of the starter looking in the directions of arrows 2—2 of FIG. 1.

Now referring to the Figures. Unitized combination motor starter 20 is generally the type of starter described in copending U.S. Pat. No. 4,066,989 issued Jan. 3, 1978 to K. T. Krueger for a Trip Unit Tie Bar Having Integral Flexible Connected Links. Starter 20 includes a molded insulating housing consisting of base 21 and removable shallow front cover 22 secured in operative position by screws 19. Cover 22 and base 21 are provided with aligned longitudinally extending internal parallel ribs (not shown) that mate to form interior elongated parallel compartments or chambers. Three of these compartments have current carrying elements identical to those illustrated in the right hand portion of FIG. 2, and constitute a pole of the three pole circuit breaker portion 59 of starter 20. A removable side cover (not shown) is provided for chamber 67 which encloses spring powered trip free contact operating mechanism 70 of FIG. 3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay 18 of FIG. 1.

Coil 35 is part of circuit breaker calibrating assembly 50 removable and replaceable from the front of starter 20 after front cover 22 is removed. The calibrating assemblies 50 of all three poles may be individual units or they may be connected to a common insulating member 69 so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of radial adjusting bar 55 remote from its pivot provided by pins 62. Thus, spring 54 biases the forward end of armature 52 away from magnetic frame 48.

Figures 5, 5A, 5B, 5C:
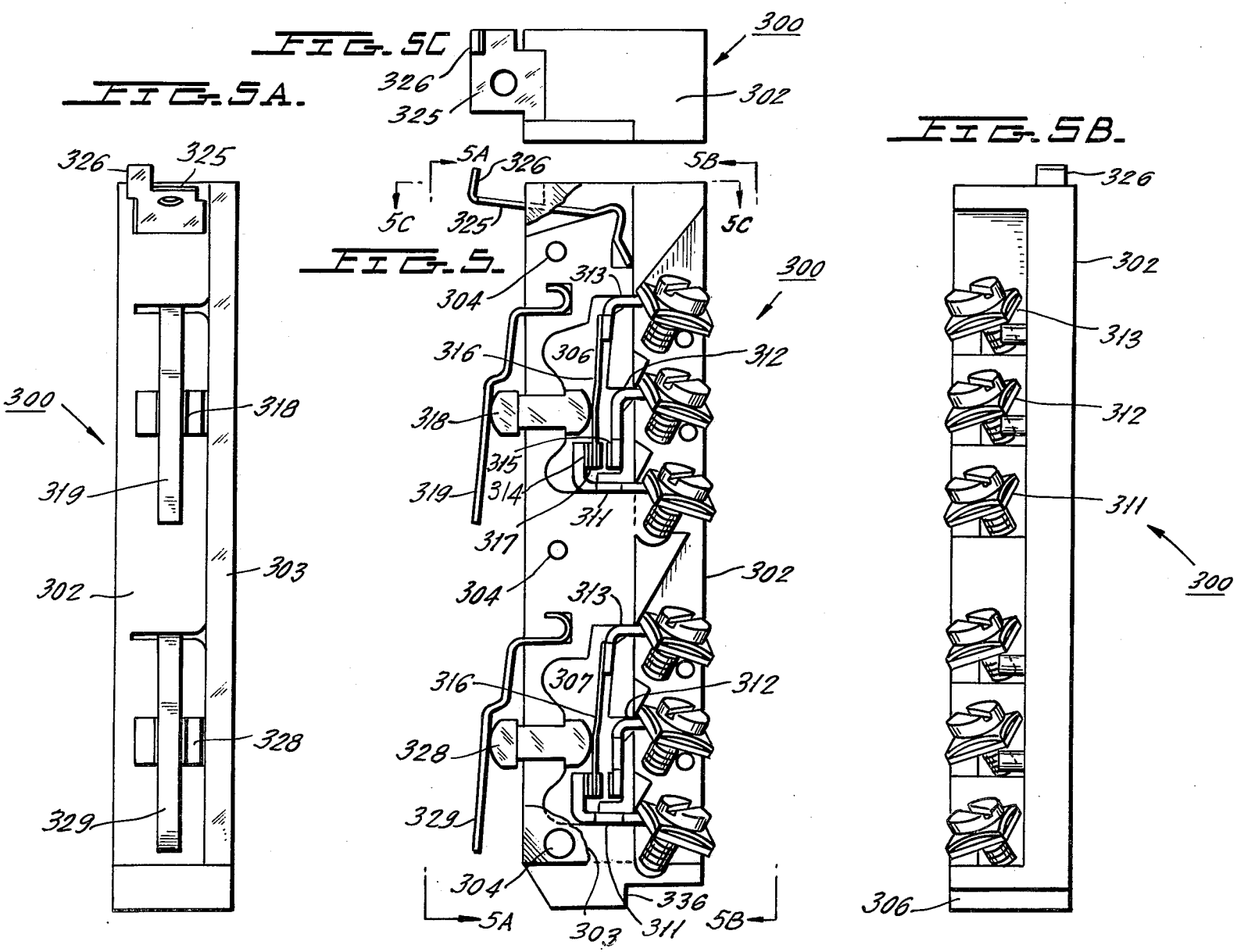
FIG. 5 is a side elevation of an auxiliary switch assembly constructed in accordance with teachings of the instant invention with the near housing wall removed to reveal the internal elements.
FIGS. 5A–5C are additional elevations of the switch assembly of FIG. 5 looking in the directions of the respective arrows 5A—5A, 5B—5B and 5C—5C.

The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within aperture **65*a* of auxiliary cover 110 (FIG. 5). Turn-to-trip control 18 extends through and is journalled for movement within aperture 18*a* of auxiliary cover 110. Both controls 65 and 18 are accessible for operation through apertures in main cover 22**.

Upon the occurrence of predetermined fault current conditions the flux generated by current flowing in coil 35 attracts armature 52 to stationary frame 48 causing bifurcated armature bracket 71 to engage enlarged formation 72 on transverse extension or link 73 of common trip bar unit 75. This pivots the latter clockwise about an axis coinciding with axis 62 for adjusting bar 55 which causes screw 76 (FIG. 3) on radial projection of unit 75 to pivot primary latch member 78 in a clockwise or tripping direction about its pivot 79, thereby releasing latching point 81 of secondary latch plate 951 on pivot 952 which in turn releases latching point 953 of cradle 80 so that the latter is free to pivot clockwise about pivot 82. Pivot 79 is formed by a screw which secures primary latch 78 loosely to one end of trip bar unit 75. Torsion spring 961, wound about the rivet forming secondary latch pivot 952, extends through an aperture in primary latch 78 to bias the latter in its latching direction (counterclockwise with respect to FIG. 3). Coiled tension spring 962 biases the upper end of resetting slot 963 in secondary latch 951 toward pivot 952. As cradle 80 pivots clockwise, end 83 of upper toggle link 84 moves up and to the right with respect to FIG. 3 permitting coiled tension main operating springs 86, connected between toggle knee 87 and pin 964 on operating member 91, to collapse toggle 84, 85 and move member 91 counterclockwise on its pivot center 89. Member 91 is manually operated by handle 146 through 139. Handle 146 is mounted to platform 135 on pivot pin 136.

The lower end of lower toggle link 85 is pivotally connected at 92 to the free end of radial extension 93 of conatact carrier 90. This causes carrier 90 to pivot clockwise with respect to FIG. 3 and by so doing moves the contact arms 31 of all three poles to the solid line or open circuit position of FIG. 2. It is noted that base 21 is a multipart unit having sections which mate along dividing line 23 so that the reduced diameter bearing portions of contact carrier 90 may be inserted and captured in operative positions. In the closed position of circuit breaker portion 59 an individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serves to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73.

Figure 6:
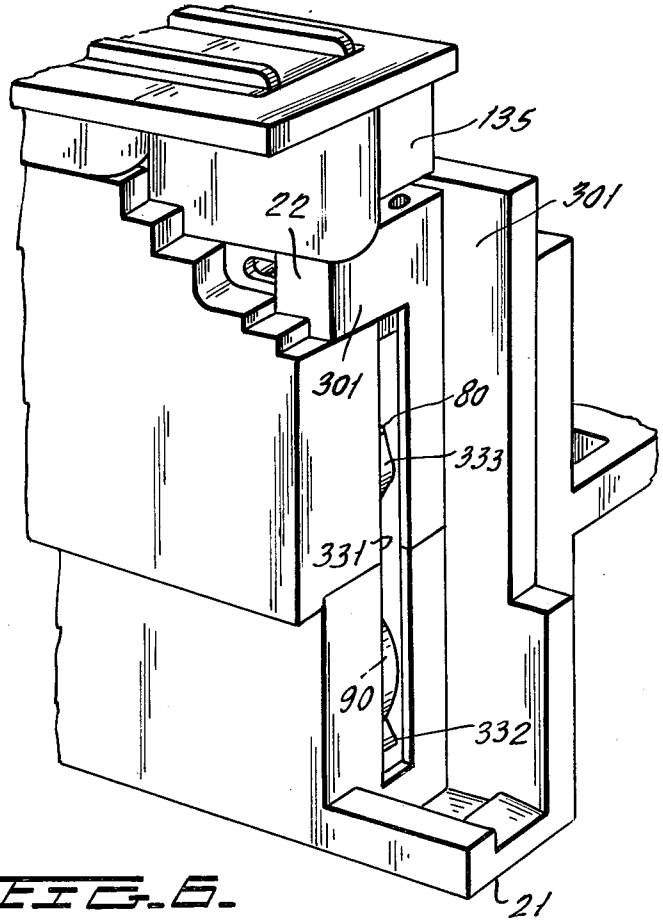
FIG. 6 is a fragmentary perspective of the circuit breaker housing in the region of the recess wherein the auxiliary switch assembly is mounted.
Figure 7:
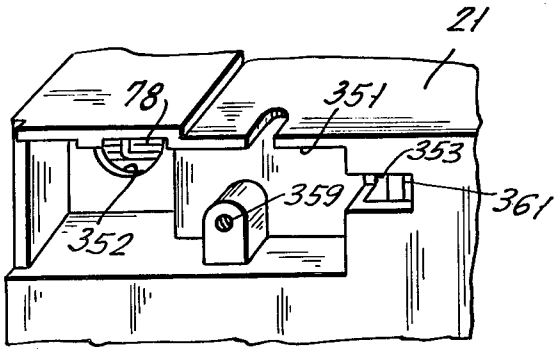
FIG. 7 is a fragmentary perspective of the circuit breaker housing in the region of the cavity wherein the shunt trip device is mounted.

One corner of housing 21, 22 is provided with external recess (FIG. 6) wherein switch assembly 300 of FIG. 5 is mounted. Assembly 300 includes molded insulating base 302 having formations for operatively positioning the current carrying and operating elements which are retained in operative positions by cover 303 secured to base 302 by rivets 304. Assembly 300 also includes upper and lower single pole double throw switch sections 306, 307 of substantially identical construction so that only the upper switch section 306 will be described in detail.

The latter includes three terminal members 311, 312, 313 each having an externally accessible end having a wire gripping screw threadably mounted thereon. The other ends of strap 311, 312 mount the respective stationary contacts 314, 315. The other end of strap 313 mounts flexible contact arm 316 having movable contact 317 at the free end thereof. Arm 316 is disposed so that movable contact 317 is biased toward engagement with stationary contact 314. The operating means for movable contact arm 316 consists of slide 318 and spring element 319. Deflection of element 319 to the right with respect to FIG. 5 drives slide 318 to the right to deflect movable arm 316 so that movable contact 317 disengages stationary contact 314 and engages stationary contact 315.

Lower switch section 307 is provided with operating means spring member 329 and slide 328, with the latter engaging movable contact arm 316 of lower switch unit 307.

Figure 3:
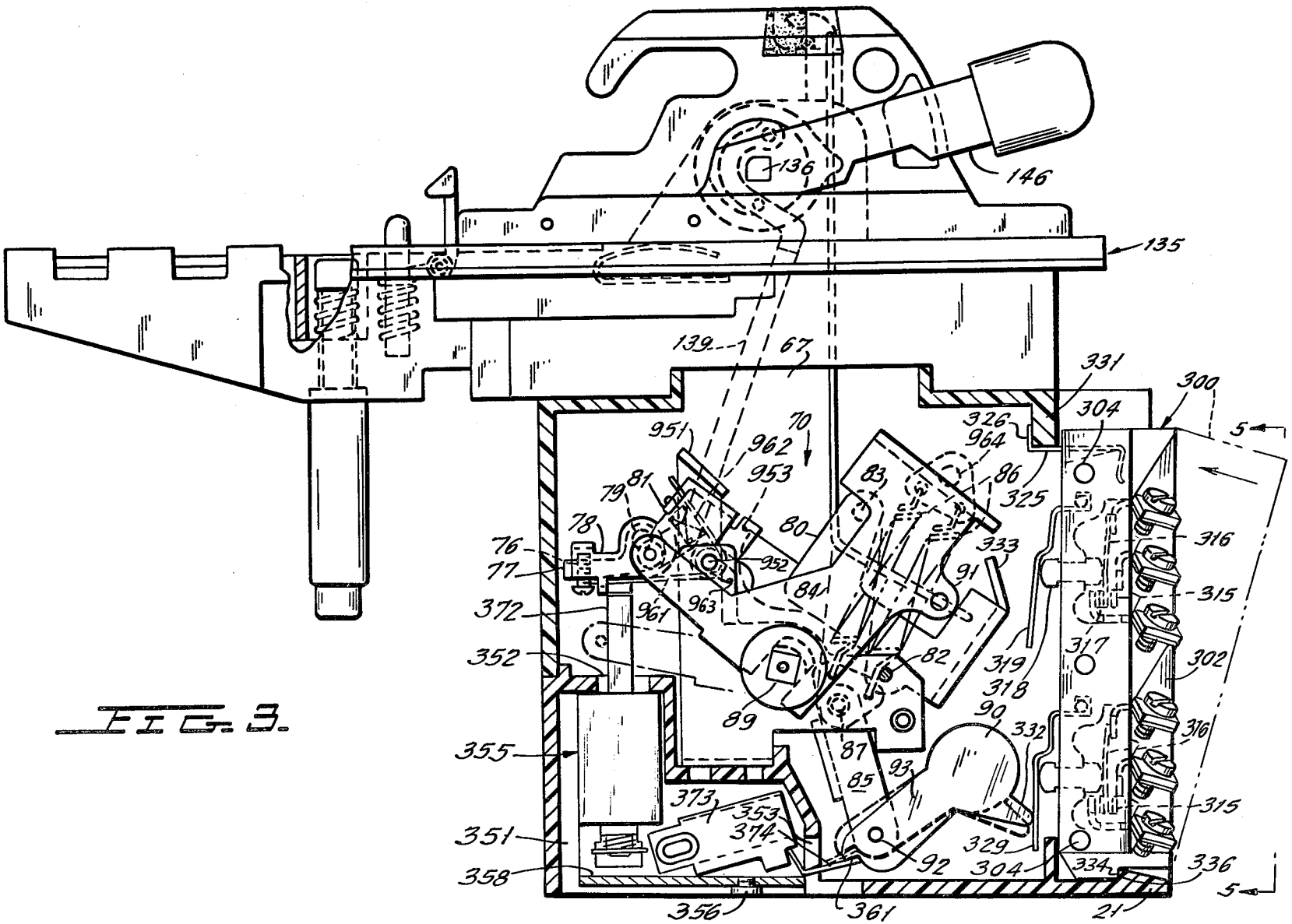
FIG. 3 is a side elevation of the contact operating mechanism looking in the direction of arrows 3—3 of FIG. 1 with the near wall of the circuit breaker housing removed to reveal the mechanical operating elements.

Elongated aperture 331 provides communication between external recess 301 and internal chamber 67. Aperture 331 is positioned adjacent to both projections 332 of contact support 90 and formation 333 of cradle 80. The bottom of recess 301 as viewed in FIG. 3 is provided with step 334 which engages cutaway 336 at the bottom of base 302 to block movement of assembly 300 to the right. Ear 326 of spring clip 325 projecting from base 302 extends upward and into engagement with a cooperating formation of platform 135 to secure the upper end of assembly 300. Both operating members 319 and 329 extend through aperture 331 into operating mechanism chamber 67.

With circuit breaker 59 closed, protrusion 332 deflects element 329 thereby operating slide 328 to the right and closing the circuit between contacts 312, 313 of lower switch 307 (see FIG. 3). When circuit breaker 59 opens, member 90 pivots clockwise and projection 332 releases operating member 329. This permits switch 307 to return to its position of FIG. 5.

With cradle 80 in its reset position of FIG. 3 upper switch section 306, typically referred to as an alarm switch, is in its position of FIG. 5. When mechanism 70 is tripped open, cradle 80 pivots clockwise from its position shown in FIG. 3 and portion 333 of cradle 80 engages operating element 319, moving slide 318 to the right with respect to FIG. 5, and thereby operating movable contact 317 of upper switch 306 into engagement with stationary contact 315 thereof.

Housing 21, 22 is also provided with external cavity 351 accessible at the rear of base 21 and communicating with internal chamber 67 by means of aperture sections 352, 353. Shunt trip assembly 355 of FIG. 4 is removably mounted within external cavity 351, being secured in operative position by screw 356 which extends through aperture 357 in support plate 358 of assembly 355 and is received by threaded aperture 359 in base 21.

Shunt trip assembly 355 includes electromagnet 363 having operating coil 364, movable armature 365 and magnetic frame member 366. Coiled compression spring 367 surrounds armature 365 and is seated between member 366 and washer 368. The latter secured to the lower end of armature 367 by screw 369. Extension 371 connects coaxial plastic rod 372 to the upper end of armature 365. Coil 364 is connected in series with the normally open contacts of microswitch 373 also mounted to support 358. Switch 373 includes spring operating member 374. Rod 372 extends through aperture 352 into chamber 67 in alignment with latch 78 and operating member 374 extends into chamber 67 in alignment with projection 361 of contact carrier 90.

With circuit breaker 59 closed, operating member 374 is deflected by formation 361 so that microswitch 373 is closed. This enables the electromagnet coil 364 to be energized by closing other switch means (not shown). Energization of coil 364 attracts armature 367 moving it upward with respect to FIG. 4, causing armature extension 372 to engage latch member 78 to pivot the latter clockwise with respect to FIG. 3 thereby release cradle 80 for tripping of mechanism 70. With circuit breaker 59 open, contact carrier formation 361 moves clear of operating member 374 to open switch 373 thereby opening the energizing circuit for magnet coil 364 to prevent extended energization thereof.

It is noted that with auxiliary switch assembly 300 mounted in recess 301 and shunt trip assembly 355 mounted within cavity 351, the overall dimensions of circuit breaker housing 21, 22 remain essentially as they were prior to mounting of assemblies 300 and 355. Further, it is noted that shunt trip assembly 355 may be replaced by an undervoltage device (not shown), in which case the electromagnet of the undervoltage device will have its armature biased so that when the electromagnet is energized the armature extension will be moved clear of latch 78.

In the following claims references to "internal" chambers means that these chambers are generally closed insofar as mounting of the circuit breaker contacts and operating mechanism is concerned unless a housing cover is removed. References to "external" recesses and cavities refer to the fact that these depressions are positioned so that the housing portions enclosing the contacts and the operating mechanism therefor need not be opened in order to insert accessory devices in such depressions.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A multipole circuit breaker including cooperating contact means for each pole thereof; a common mechanical operating mechanism for opening and closing the contact means of all poles of said circuit breaker simultaneously; said mechanism including a releasable cradle biased toward a tripped position wherein said mechanism is disabled from either closing said contact means or maintaining them closed and operable to a reset position wherein said mechanism is operable to close said contact means and maintain them closed; said mechanism also including a latch for maintaining said cradle in said reset position; fault current responsive trip means operatively connected to said latch for tripping thereof to release said cradle upon the occurrence of predetermined fault current conditions thereby enabling said mechanism to open said contact means; housing means wherein said contact means, said operating mechanism and said trip means are disposed; said housing means defining an internal chamber wherein said mechanism is mounted; said contact means being disposed outside of said chamber; said housing means defining an external recess for receiving a switch assembly without opening said housing means; said housing means including aperture means extending between said recess and said chamber and through which operating means of a switch assembly mounted in said recess extends into position for operation by said mechanism; a switch assembly mounted in said recess and including operating means extending through said aperture means into said chamber in position for operation by said mechanism; said switch assembly including first and second switch sections; said operating means includes first and second projecting members for operating the respective first and second switch sections; said first projecting member being operated by said cradle as it moves between said tripped and reset positions; said second projecting member being operated by another portion of said mechanism as the latter opens and closes said contact means.

2. A multi-pole circuit breaker as defined by claim 1 in which overall dimensions of said circuit breaker are essentially the same whether said switch assembly is or is not mounted in said recess.

3. A multi-pole circuit breaker as defined by claim 1 in which the switch assembly includes a spring lip in engagement with a cooperating external formation of said housing to removably retain said switch assembly in its operative position.

4. A multipole circuit breaker including cooperating contact means for each pole thereof; a common mechanical operating mechanism for opening and closing the contact means of all poles of said circuit breaker simultaneously; said mechanism including a releasable cradle biased toward a tripped position wherein said mechanism is disabled from either closing said contact means or maintaining them closed and operable to a reset position wherein said mechanism is operable to close said contact means and maintain them closed; said mechanism also including a latch for maintaining said cradle in said reset position; fault current responsive trip means operatively connected to said latch for tripping thereof to release said cradle upon the occurrence of predetermined fault current conditions thereby enabling said mechanism to open said contact means; housing means wherein said contact means, said operating mechanism and said trip means are disposed; said housing means defining an internal chamber wherein said mechanism is mounted; said contact means being disposed outside of said chamber; said housing means defining an external recess for receiving a switch assembly without opening said housing means; said housing means including aperture means extending between said recess and said chamber and through which operating means of a switch assembly mounted in said recess extends into position for operation by said mechanism; said housing means also defining an external cavity for receiving an auxiliary device assembly without opening said housing means; said housing means including another aperture means extending between said cavity and said chamber and through which operating means of an auxiliary device assembly mounted in said cavity extends into position for tripping of said latch; an auxiliary device assembly mounted in said cavity and including operating means extending through said another aperture means into said chamber in operative position to trip said latch.

5. A multi-pole circuit breaker as defined by claim 4 in which overall dimensions of said circuit breaker are essentially the same whether said switch assembly is or is not mounted in said recess and whether said auxiliary device assembly is or is not mounted in said cavity.

6. A multi-pole circuit breaker as defined by claim 4 in which the auxiliary device assembly includes an electromagnetic device comprising an armature for operating said operating means of said auxiliary device assembly to trip said latch.

7. A multi-pole circuit breaker as defined by claim 6 in which the auxiliary device assembly also includes a switching section having cooperating contacts series connected with an operating coil of the electromagnetic device; said operating means of said auxiliary device including first and second projecting elements connected to said electromagnetic device and said switching section, respectively; said second projecting element being operated by said mechanism as the latter opens and closes said contact means.

* * * * *